US006902465B2

(12) United States Patent
Hagan

(10) Patent No.: US 6,902,465 B2
(45) Date of Patent: Jun. 7, 2005

(54) GRINDING MACHINE

(76) Inventor: Richard Hagan, 3 Willow St., Seymour, CT (US) 06483

( * ) Notice: Subject to any disclaimer, the term of this patent is extended or adjusted under 35 U.S.C. 154(b) by 47 days.

(21) Appl. No.: 10/296,367

(22) PCT Filed: Jun. 21, 2001

(86) PCT No.: PCT/GB01/02736

§ 371 (c)(1),
(2), (4) Date: Nov. 22, 2002

(87) PCT Pub. No.: WO01/98026

PCT Pub. Date: Dec. 27, 2001

(65) Prior Publication Data

US 2004/0092213 A1 May 13, 2004

(30) Foreign Application Priority Data

Jun. 21, 2000 (GB) ..... 0015066

(51) Int. Cl.[7] ..... B24B 49/00; B24B 1/00; B24B 7/00

(52) U.S. Cl. ..... 451/5; 451/49; 451/62; 451/121; 451/142; 451/166; 451/236; 451/251

(58) Field of Search ..... 451/5, 178, 236, 451/251, 49, 62, 121, 140, 142, 150, 163, 164, 166

(56) References Cited

U.S. PATENT DOCUMENTS

| | | | | |
|---|---|---|---|---|
| 4,897,964 A | * | 2/1990 | Vetter | 451/72 |
| 6,200,200 B1 | * | 3/2001 | Himmelsbach | 451/62 |
| 6,390,892 B1 | * | 5/2002 | Klicpera | 451/47 |
| 6,561,882 B2 | * | 5/2003 | Mizutani et al. | 451/58 |
| 6,685,536 B1 | * | 2/2004 | Junker | 451/5 |

FOREIGN PATENT DOCUMENTS

DE 019813165 A1 * 10/1999

* cited by examiner

*Primary Examiner*—Timothy V. Eley
(74) *Attorney, Agent, or Firm*—Reising, Ethington, Barnes, Kisselle, P.C.

(57) ABSTRACT

A grinding machine uses a conical grinding wheel (10) to create a non-circularly symmetric surface (defining, for example, a re-entrant cam) on a workpiece. The machine is operable to rotate such a workpiece about a first axis (5) and the machine has drive means for rotating the conical wheel about a second axis (14). A feeding mechanism brings the wheel into contact with the workpiece to define a line of grinding where the wheel contacts the workpiece (i.e. a cutting line). In use, a rocking movement is imparted to the wheel and spindle relative to the workpiece as the latter rotates so as to maintain the orientation of the cutting line relative to the first axis and of the second axis relative to the cutting line.

14 Claims, 5 Drawing Sheets

46
26
36
18
16
8
10
3
2
32
40

46
8
20
6
10
4
2
1

GRINDING MACHINE

FIELD OF THE INVENTION

This invention relates to grinding machines for grinding non-cylindrical surfaces on workpieces, in particular camshafts having re-entrant cams, and to a method of grinding a non-cylindrical surface on a workpiece.

BACKGROUND TO THE INVENTION

A re-entrant cam is one in which the flanks, connecting the arcuate base and tip of the cam, have concave portions. Many designs of internal combustion engines have camshafts which carry re-entrant cams which are believed to provide superior control of the opening and closing of inlet and exhaust valves. Such camshafts are generally ground using grinding machines which have relatively small diameter grinding wheels to enable the concave portions to have relatively small radii of curvature.

However, where such a grinding wheel is mounted on a spindle assembly that extends parallel to the axis of the workpiece (on which the camshaft is to be ground), the smaller radius of the grinding wheel, in effect, limits the maximum permissible size of the spindle assembly as too large an assembly may collide with the workpiece. In an attempt to solve this problem, some known designs of grinding machine, for example as shown in U.S. Pat. No. 5,392,566, use two grinding wheels, a larger diameter wheel for obtaining the general cam profile, and a smaller diameter wheel which is subsequently applied to the workpiece to create the concave flanks. However, the need to provide two grinding wheels inevitably increases the complexity of this arrangement compared with a machine having just the one grinding wheel.

A larger spindle assembly can be used to support a small grinding wheel if the spindle assembly extends at a non-parallel angle to the angle of the workpiece. An example of such an arrangement is shown in WO 97/44159 in which a conical grinding wheel is mounted on a spindle which extends at an angle of approximately 10 to 30° to the workpiece axis. The wheel is conical, and is so arranged that the cutting line, i.e. the zone of contact between the grinding wheel and the workpiece, extends substantially parallel to the workpiece axis. To that end, it is necessary to ensure that, as the workpiece rotates, the angular position of the cutting line relative to the grinding wheel axis remains unchanged. This is achieved in WO 97/44159 by moving the grinding wheel and its spindle assembly in a linear vertical direction (perpendicular to the in-feed axis).

However, such a movement can cause uneven cutting conditions which, in turn give rise to problems of coolant application and limitations to the minimum radius of curvature that can be formed in the cam flanks.

SUMMARY OF THE INVENTION

According to a first aspect of the invention, there is provided a grinding machine for grinding a non-circularly symmetric surface on a workpiece, the machine comprising receiving means for receiving the workpiece in such a way as to enable the latter to be rotated about a first axis, a tapered grinding wheel mounted on a spindle which is angled relative to the first axis, drive means for rotating the wheel about a second axis, feed means for bringing the wheel into contact with the workpiece to define a line of grinding where the wheel contacts the workpiece, and orientation means operable to cause a rocking movement of the wheel and spindle relative to the workpiece as the latter rotates, thereby to maintain the orientation of the cutting line relative to the first axis and of the second axis relative to the cutting line.

By causing a rocking movement to the spindle and grinding wheel, the orientation means can be configured to ensure that the cutting conditions remain substantially consistent as the workpiece rotates. In addition, the direction of the grinding force applied by the wheel to the workpiece can be substantially constant relative to the axis about which it rotates and the spindle bearings, and the application of coolant can also remain constant.

Preferably, said orientation of the cutting line relative to the first axis is one in which it is parallel to said axis at any position around the first axis.

Preferably, the second axis is so positioned that, in use, a radius from the wheel to the cutting line remains substantially perpendicular to the tangent to the workpiece at the line of grinding for all angular positions of the workpiece. In the arrangement shown in WO 97/44159, the vertical translational movement of the grinding wheel maintains the orientation of the cutting line relative to the workpiece axis, but causes variations in the angle between the radius of the wheel and the tangent of the workpiece at the cutting line. These variations, in turn, increase the minimum radius of a concave section that can be created by the cutting wheel. By contrast, the orientation means of the present invention enables the cutting wheel to create a concave portion of a radius which corresponds to the larger radius of the wheel.

Preferably, said rocking motion is also such as to maintain the angle between the direction of the force applied to the grinding wheel by the feed means and the surface being ground.

Preferably, the orientation means is so arranged that said rocking motion comprises rotation about an axis defied by said cutting line.

This arrangement reduces the sensitivity of the machine to any errors that the orientation means might introduce into the position of the grinding wheel.

Preferably, the receiving means comprises a headstock and a tailstock, the apparatus also comprising rotation means for rotating either the headstock or the tailstock to cause rotation of a workpiece about the first axis, the apparatus further comprising control means operable to control the rotation means, the feed means and the orientation means thereby to control the relative positions and movements of a workpiece, the grinding wheel and its spindle and the orientation of the wheel and spindle.

The control means is preferably operable to cause the apparatus to create a re-entrant cam surface on a workpiece.

Preferably, the feed means is operable to cause the grinding wheel to move towards the workpiece along the second axis.

The invention also lies in a method of grinding a non-circularly symmetric surface on a workpiece, the method comprising the steps of rotating a workpiece about a first axis, urging a rotating conical grinding wheel against the workpiece, the wheel axis being so inclined relative to the first axis that the wheel and workpiece make contact along a cutting line substantially parallel to the first axis, moving the wheel towards and away from the said first axis (in a feed direction) so that the cutting line follows a series of predetermined profiles until the desired surface is formed, wherein the wheel is also rocked about the cutting line so as to maintain the orientation of the latter relative to the first axis.

Preferably, the surface created by the method comprises a re-entrant cam.

BRIEF DESCRIPTION OF THE DRAWINGS

The invention will now be described, by way of example only, with reference to the accompanying drawings in which.

DETAILED DESCRIPTION

Figure 1:
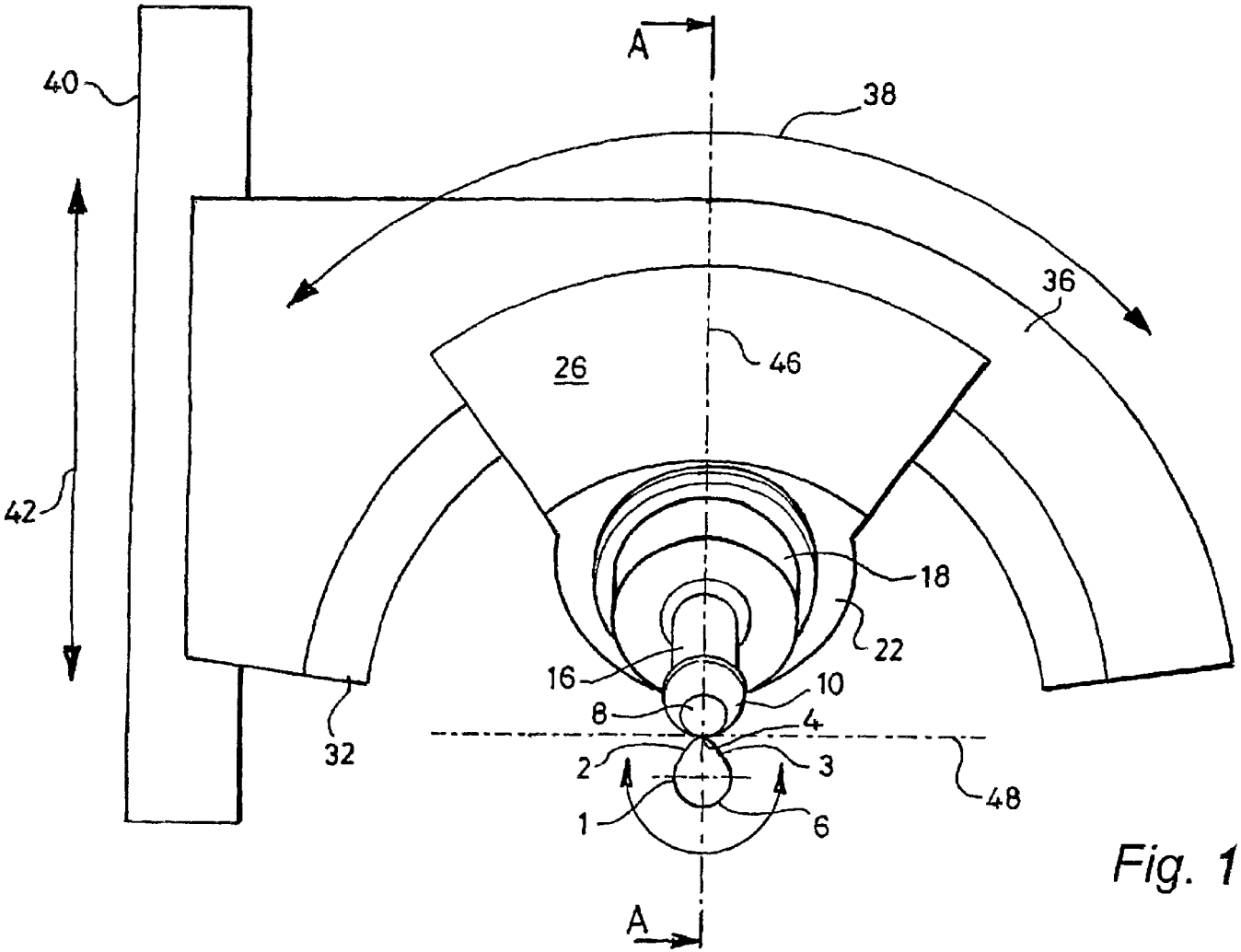
FIG. 1 is an end elevational view of part of a grinding machine in accordance with the invention (and of a workpiece)
Figure 2:
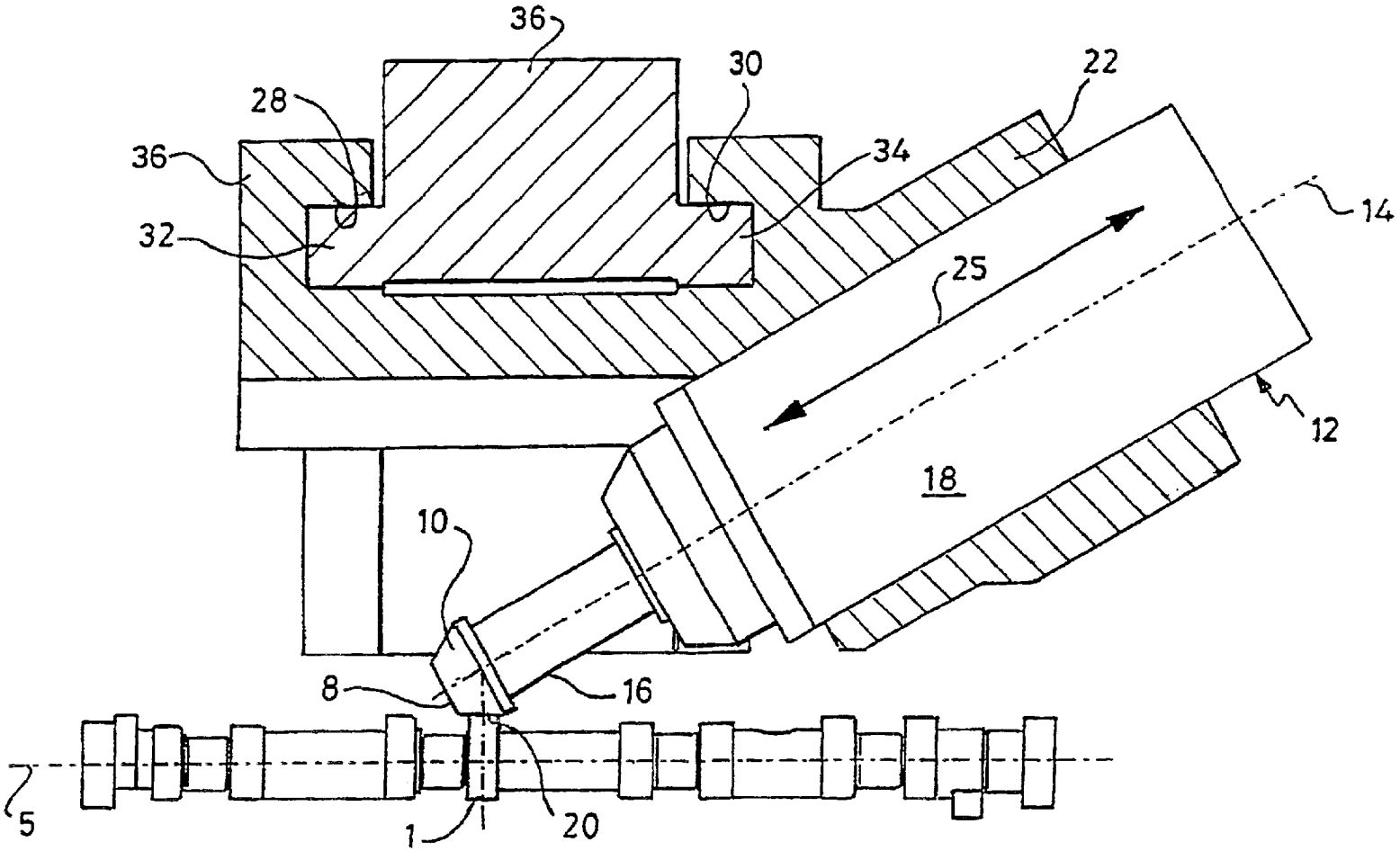
FIG. 2 is a sectional plan elevation taken along the line A—A of FIG. 1.

With reference to FIGS. 1 and 2, a grinding machine in accordance with the invention is arranged to grind a re-entrant camming surface 1 from a workpiece mounted on a headstock and tailstock (not shown) of the machine. The machine also includes a suitable drive (not shown) for rotating the workpiece at a controlled rate. FIG. 1 shows a desired cam profile which includes concave portions 2 and 3 in the cam flanks, and an arcuate tip 4 and base 6.

The axis about which the workpiece is rotated is perpendicular to the plane of FIG. 1 and is denoted by the reference numeral 5 in FIG. 2.

The cam 1 is ground by a conical grinding wheel 8 which has a grinding surface 10, and is mounted on a shaft 16 forming part of the spindle assembly 12. The assembly 12 has a housing 18 which contains a motor for rotating the grinding wheel 8 about the axis 14. The grinding wheel 8 and spindle assembly 12 are mounted on a carriage 22 which is arranged for pivotal movement by up to 90about a pivot axis that is parallel to the axis 5 and passes through the point of contact between the wheel 8 and the workpiece 1.

As can be seen from FIG. 2, the axis 14 is disposed at an angle to the axis 5. The surface 10 is disposed at the same angle to the axis 14 so that the portion of the wheel 8 in contact with the cam 1 is substantially parallel to the axis 5. That portion defines a line of grinding, referenced 20 in FIG. 2, between the wheel 8 and the cam 1. The housing 18 of the spindle assembly 12 is slidably mounted in the carriage 22, and the apparatus includes an adjustment mechanism in the form of an axial drive which acts between the carriage 22 and the housing 18 to move the spindle assembly 12, and hence the grinding wheel 10 in either direction along the axis 14, as indicated by the double-headed arrow 25.

The top of the carriage 22 is part circular and has a connector 26 formed as a similarly curved T-shaped recess for defining two downwardly facing curved shoulders shown as 28 and 30 in FIG. 2.

The shoulders bear against two curved rails 32 and 34 so as to retain the yoke 22 in position on a support 36. The rails 32, 34 and shoulders 28 and 30 have the same center of curvature, which defines the axis about which the wheel 8 and spindle assembly pivot. Drive means (such as a rack and pinion mechanism) is provided between the yoke 26 and the rail 32 to enable the yoke to be rocked by being pivotted in the direction indicated by the double-headed arrow 38 of FIG. 1 about that axis, which is parallel to the axis 5 and passes through the line of grinding 20.

The support 36 is slidably mounted on a linear, horizontal support member 40 extending below the workpiece, and the machine includes further feed means in the form of a drive for moving the support 36, and hence the yoke 22 and wheel 8 in the linear directions indicated by the double headed arrow 42.

The operation of the apparatus will now be described.

When the cam 1 is in the position shown in FIG. 1, its tip 4 is closest to the wheel 10 and the carriage 22 is centrally positioned on the rails 30 and 32. With the carriage 22 in this position, the line (denoted by the reference numeral 46) defined by the projection of the axis 14 onto the plane of FIG. 1 is horizontal, and is therefore at 90° to the tangent, indicated by line 48 of the cam 1 at the cutting line 20. The feed means is operable to move the spindle 18 along the directions indicated by the arrow 42 to move the wheel 8 towards and away from the cam 1 to grind the cam into the required profile.

Figures 3, 4:
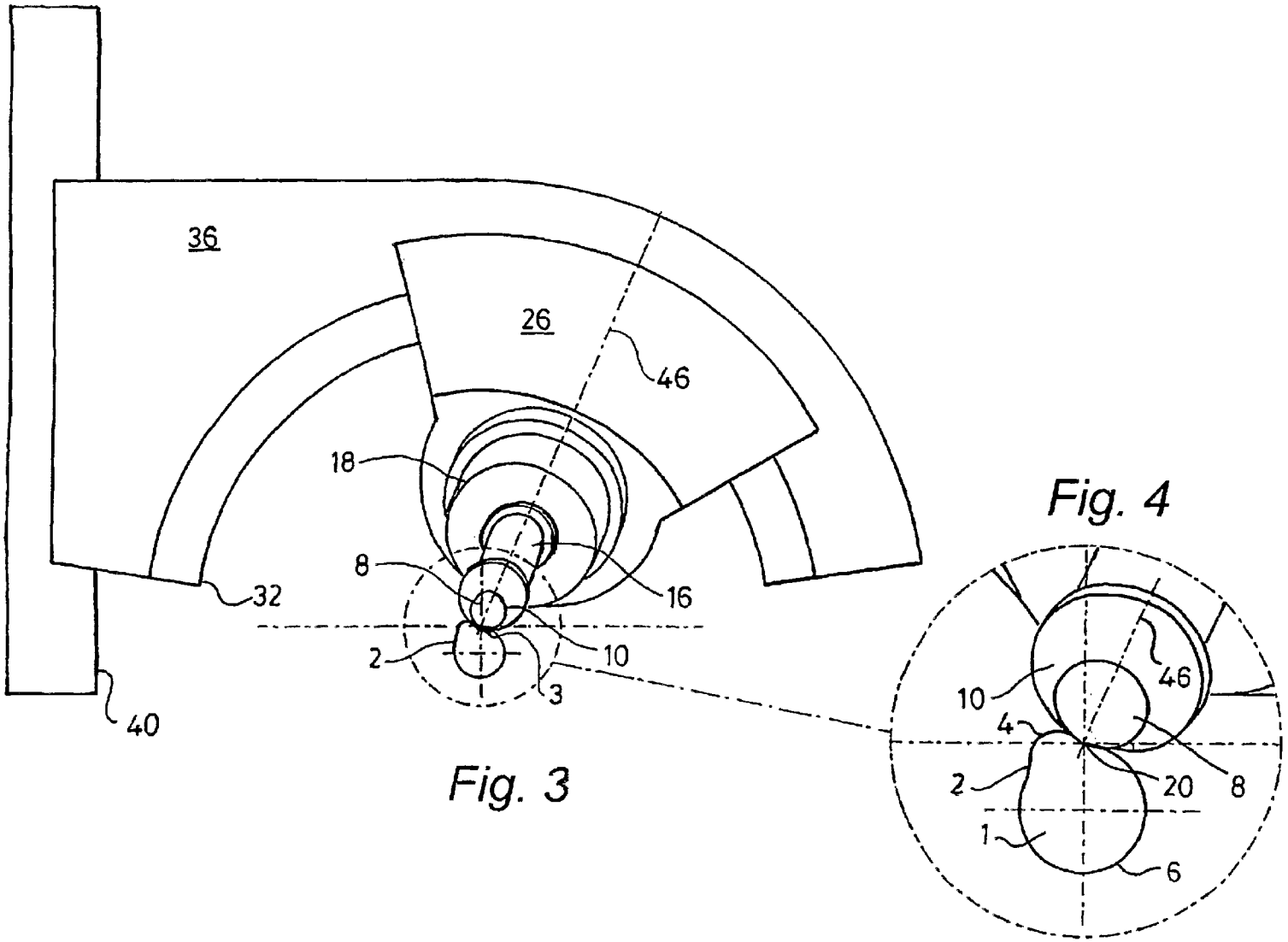
FIG. 3 is a view, taken from the same position as FIG. 1, of the apparatus in use.
FIG. 4 is a detailed view of the apparatus and workpiece shown in FIG. 3.

FIG. 3 shows the apparatus after the cam 1 has moved, in an anti-clockwise direction through a small angle until the concave flank 3 is at the cutting line 20. As the cam 1 moves from the position shown in FIG. 1 to that of FIG. 3, the carriage 22 travels along the rails 32 and 34 first in a clockwise direction (as viewed from FIG. 3) and then in an anti-clockwise direction until the position shown in FIG. 3 is reached. Thus, the grinding wheel 8 and spindle assembly 18 are rotated through a small angle about an axis perpendicular to the plane of FIG. 3, through the cutting line 20 (and parallel to the axis 5). The angle through which this rotation occurs is sufficient to maintain a 90° angle between the projection line 46 and the tangent to the cam at the cutting line 20.

Figures 5, 7:
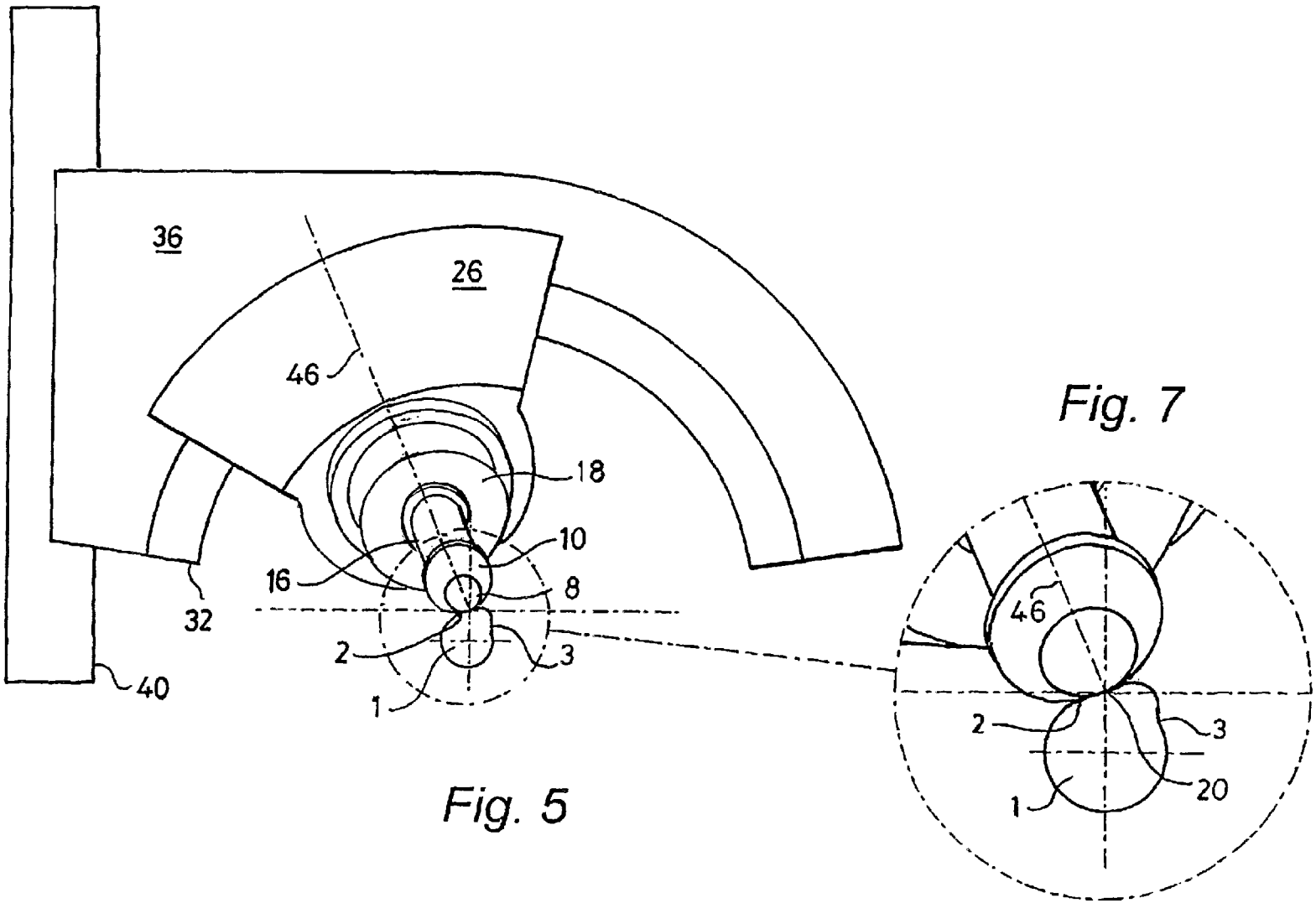
FIG. 5 corresponds to FIG. 3, but shows the machine with the workpiece at a different angular orientation.
FIG. 7 is an enlarged view of the portion of FIG. 5 contained within the circle.
Figure 6:
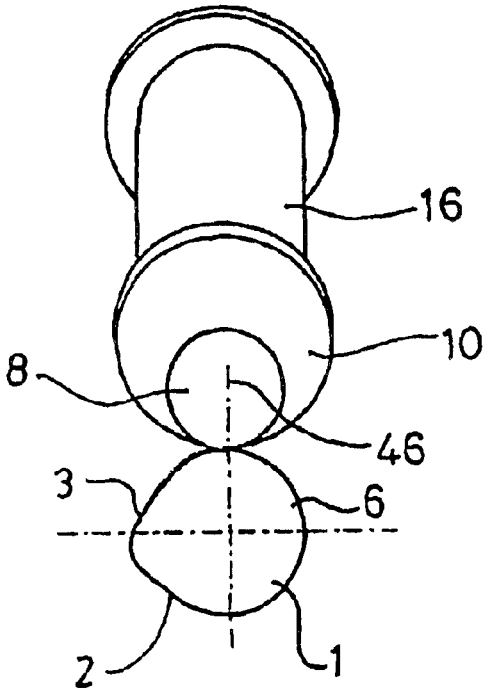
FIG. 6 is a simplified end view of the workpiece and grinding wheel and spindle assembly of the apparatus when the workpiece is at a third angular position.

As the cam 1 continues to rotate in an anti-clockwise direction, the wheel 8 reaches the part circular base 6 (for example as shown in FIG. 6). As this happens the carriage 22 is driven back to the position shown in FIG. 1, so that the line 46 is once again horizontal. As the rotation of the cam 1 brings the concave flank 2 into contact with the grinding wheel 10, the carriage 22 moves along the rails 32 and 34 in the opposite direction to the movement from the FIG. 1 to the FIG. 3 position so that the carriage 22, and hence the wheel 8 and spindle assembly 18 rotate in an anti-clockwise and then clockwise direction, until the position shown in FIG. 5 is reached. Again, as is apparent from FIGS. 5 and 7, the projection 46 remains perpendicular to the tangent to the cam 1 at the cutting line 20.

Thus, as the cam 1 turns through a full revolution, the carriage 22, and hence the wheel 8 and spindle 18, rocks about the axis parallel to the workpiece axis 5 and through the line 20.

It will be appreciated that the direction of the grinding force is always constant relative to the pivot axis about which the spindle 18 and wheel 8 rock, and to the spindle bearings. This helps to ensure that cutting conditions are kept substantially constant, and enables the wheel 8 to grind a concave flank 2 or 3 of a diameter corresponding to the largest diameter of the grinding surface 10. Thus, compared with known arrangements, a larger diameter wheel can be used to grind re-entrant form or, conversely, a smaller re-entrant form can be ground with a wheel of a given size, compared with the apparatus shown in WO 97/44159.

As the adjustment mechanism shown in sectional view in FIG. 2 can move the spindle assembly 12 in either direction indicated by the arrow 25, it can be used to maintain the grinding line 20 at the center of curvature of the rails 32 and 34 and of the shoulders 28 and 30 (and hence on the pivot axis of the spindle assembly 12 regardless of the effects of wheel wear and dressed off shock).

What is claimed is:

1. A grinding machine for grinding a non-circularly symmetric surface on a workpiece, the machine comprising means for receiving the workpiece in such a way as to enable the latter to be rotated about a first axis, a tapered grinding wheel mounted on a spindle which is angled relative to the first axis, drive means for rotating the wheel about a second axis, feed means for bringing the wheel into contact with the workpiece to define a cutting line where the wheel contacts the workpiece, characterized in that the machine includes orientation means operable to cause a rocking movement of the wheel and spindle relative to the workpiece as the latter rotates, and in that the orientation of the cutting line relative to the first axis is one in which it is parallel to said axis at any position around the first axis, whereby the orientation of the cutting line is maintained relative to the first axis and to the second axis relative to the cutting line.

2. The grinding wheel according to claim 1, in which the second axis is so positioned that, in use, a radius from the wheel to the cutting line remains substantially perpendicular to the tangent to the workpiece at the cutting line for all angular positions of the workpiece.

3. The grinding wheel according to claim 2, in which the orientation means is so arranged that said rocking motion comprises rotation about an axis defined by said cutting line.

4. The grinding machine according to claim 2, in which said rocking motion is also such as to maintain the angle between the direction of the force applied to the grinding wheel by the feed means and the surface being ground.

5. A The grinding wheel according to claim 4, in which the orientation means is so arranged that said rocking motion comprises rotation about an axis defined by said cutting line.

6. The grinding machine according to claim 1, in which the receiving means comprises a headstock and a tailstock, the apparatus also comprising rotation means for rotating either the headstock or the tailstock to cause rotation of a workpiece about the first axis, the apparatus further comprising control means operable to control the rotation means, the feed means and the orientation means thereby to control the relative positions and movements of a workpiece, the grinding wheel and its spindle and the orientation of the wheel and spindle.

7. The grinding machine according to claim 6, in which the control means is preferably operable to cause the machine to create a re-entrant cam surface on a workpiece.

8. The grinding wheel according to claim 6, in which the second axis is so positioned that, in use, a radius from the wheel to the cutting line remains substantially perpendicular to the tangent to the workpiece at the cutting line all angular position of the workpiece.

9. The grinding machine according to claim 8, in which the orientation means is so arranged that said rocking motion comprises rotation about an axis defined by said cutting line.

10. The grinding machine according to claim 8, in which said rocking motion is also such as to maintain the angle between the direction of the force applied to the grinding wheel by the feed means and the surface being ground.

11. The grinding wheel according to claim 10, in which the orientation means is so arranged that said rocking motion comprises rotation about an axis defined by said cutting line.

12. The grinding machine according to claim 1, in which the feed means is operable to cause the grinding wheel to move towards the workpiece along the second axis.

13. A method of grinding a non-circularly symmetric surface on a workpiece, the method comprising the steps of rotating a workpiece about a first axis, urging a rotating conical grinding wheel against the workpiece, the wheel axis being so inclined relative to the first axis that the wheel and workpiece make contact along a cutting line substantially parallel to the first axis, moving the wheel towards and away from the said first axis (in a feed direction) so that the cutting line follows a series of predetermined profiles until the desired surface is formed, and rocking the wheel axis by rotating the wheel axis in a curved path about an axis defined by said cutting line so as to maintain the orientation of the latter relative to the first axis.

14. The method according to claim 13, in which the surface created by the method comprises a re-entrant cam.

* * * * *

UNITED STATES PATENT AND TRADEMARK OFFICE

CERTIFICATE OF CORRECTION

PATENT NO. : 6,902,465 B2
DATED : June 7, 2005
INVENTOR(S) : Hagan

It is certified that error appears in the above-identified patent and that said Letters Patent is hereby corrected as shown below:

Column 2,
Line 37, after “about an axis” delete “defied” and insert therein -- defined --.

Column 3,
Line 45, after “movement by up to 90” insert therein -- º --.

Column 5,
Line 39, after “5.” delete “A”.

Signed and Sealed this

Twenty-third Day of August, 2005

JON W. DUDAS
*Director of the United States Patent and Trademark Office*